United States Patent [19]

Couwenberg

[11] 4,237,401

[45] Dec. 2, 1980

[54] LOW-PRESSURE MERCURY VAPOR DISCHARGE LAMP

[75] Inventor: Winston D. Couwenberg, Eindhoven, Netherlands

[73] Assignee: U.S. Philips Corporation, New York, N.Y.

[21] Appl. No.: 952,368

[22] Filed: Oct. 18, 1978

[30] Foreign Application Priority Data

Nov. 2, 1977 [NL] Netherlands ..... 7712058

[51] Int. Cl.[3] ..... H01J 61/20

[52] U.S. Cl. ..... 313/225; 313/227

[58] Field of Search ..... 313/225, 227, 229

[56] References Cited

U.S. PATENT DOCUMENTS

| | | | |
|---|---|---|---|
| 3,351,798 | 11/1967 | Bauer | 313/229 X |
| 3,416,023 | 12/1968 | Eckel et al. | 313/225 |
| 3,867,665 | 2/1975 | Furmidge et al. | 313/225 X |
| 3,958,145 | 5/1976 | Jack et al. | 313/229 X |

*Primary Examiner*—Palmer C. Demeo

*Attorney, Agent, or Firm*—Robert S. Smith

[57] ABSTRACT

Low-pressure mercury vapor discharge lamp having a discharge vessel comprising at least two thermally emitting electrodes as well as mercury and a rare gas or a combination of rare gases, the discharge vessel being provided with a glass wall permeable to the ultra-violet radiation generated in the mercury discharge, at least a halide of mercury being present in the discharge vessel.

1 Claim, 1 Drawing Figure

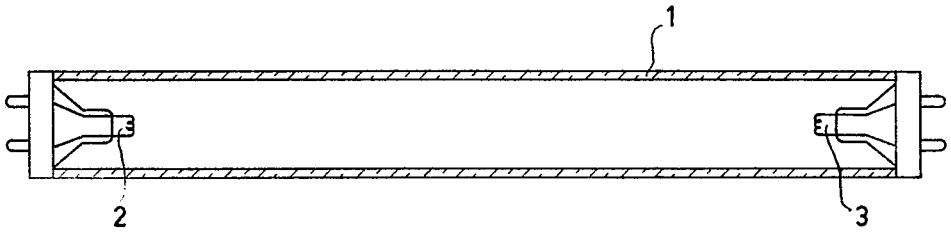
1
2
3

LOW-PRESSURE MERCURY VAPOR DISCHARGE LAMP

The invention relates to a low-pressure mercury vapor discharge lamp having a discharge vessel in which there are at least two thermally emitting electrodes as well as mercury and a rare gas or combination of rare gases, the discharge vessel having a glass wall which is permeable to the ultra-violet radiation generated in the mercury discharge. These lamps are commercially available and are described for example in Dutch Pat. No. 7406495.

The above-mentioned radiation lamps in which the inner wall of the discharge vessel is generally not coated with a luminescent layer are, for example, used in places where the atmosphere must be purified from unwanted bacteria, bacilli, fungi and suchlike, such as in hospitals or laboratories.

The ultra-violet radiation emitted by these lamps comprises mainly the resonant radiation generated in the mercury discharge with a wave length of 254 nm. Therefore the glass wall of these lamps is of such a composition that it is permeable to said resonant radiation and resistant to the action of that radiation.

One of the problems encountered during the life of these radiation lamps is the occurrence of blackening, i.e. dark stains and spots on the inner wall by interaction of the mercury discharge and the glass wall. It appears that this is especially the case at relatively high current densities. It was found that the above-mentioned blackening consists inter alia of an alloy of one or more elements diffused from the glass wall, such a sodium, and the mercury present in the discharge vessel. The dark stains and spots give the lamp an unaesthetic appearance and adversely affect the operation and the radiant flux of the lamp.

It is an object of the invention to provide a low-pressure mercury vapor discharge lamp having a glass wall permeable to the ultra-violet radiation generated in the mercury discharge, which obviates the above-mentioned drawbacks of the prior art lamps to a considerable degree.

A low-pressure mercury vapor discharge lamp of the type specified in the preamble is characterized in accordance with the invention that there is at least a halide of mercury in the discharge vessel.

It appeared that, if there is a mercury halide, such as mercury iodide or mercury bromide, in the discharge vessel, blackening of the wall is very slight. A precise explanation for the markedly reduced blackening can hardly be given but it is assumed that, after the mercury halide near the axis of the discharge is split by the discharge into mercury ions and halogen ions these ions easily reecombine into the halide near the wall of the discharge vessel, thereby preventing the metals and metal ions diffused from the glass wall from forming unwanted dark mercury alloys with mercury or mercury ions.

It should be noted that it is known in incandescent lamps and high pressure discharge lamps (for example from German Pat. No. 464,876 and German Pat. No. 1,286,637), to introduce with bulbs and high-pressure discharge lamps a quantity of a halogen, such as iodine or bromium in the bulb or in the discharge vessel to prevent blackening of the wall. In such lamps the chemical transport returns the tungsten which is removed due to evaporation from the filament or the electrode back to said filament or electrode, thus preventing the tungsten from depositing as dark stains on the wall. Such a tungsten regeneration cycle can, however, only occur at temperatures which are considerably higher than the temperatures prevailing in low-pressure mercury vapor discharge lamps. The vapor pressure of 0.006 torr, which is the critical vapor pressure for the optimum conversion of electric power into ultra-violet radiation is already achieved in low-pressure mercury vapor discharge lamps at the operating temperature of approximately 40° C.

In a preferred embodiment of a lamp according to the invention between 0.005 and 0.05 mg/cm$^3$ of mercury iodide is present in the discharge vessel. Blackening of the lamp wal! is then negligible.

The invention will be further explained with reference to a drawing which shows schematically a longitudinal section of a low-pressure mercury vapor discharge lamp according to the invention.

The depicted lamp is a low-pressure mercury vapor discharge lamp having a power of 40 W, which lamp mainly emits radiation of a wavelength of 254 nm. The lamp is 44 cm long, its diameter is 2.5 cm. The cylindrical discharge vessel is represented by 1. The wall of the discharge vessel consists of glass which is transmissive to the resonance line emitted by the mercury discharge with a wavelength of 254 nm. The composition of this glass in a percentage by weight is as follows: 68.8% $SiO_2$; 2.9% $B_2O_3$; 9.1% $Na_2O$; 10.9% $K_2O$; 6.8% BaO and 1.5% $Al_2O_3$. Thermally emitting electrodes 2 and 3 are disposed at the two ends of the discharge vessel. The discharge vessel contains a quantity of 15 mg of mercury. The mercury can be introduced into the discharge vessel by means of a glass mercury capsule, as described in United Kingdom Pat. No. 1,267,175. Furthermore there is a quantity of argon at a pressure of 4 torr and a quantity of 8.0 mg of mercury diodide in the discharge vessel. After 2000 operating hours it appeared that the radiant flux of this lamp with a lamp current of 1200 mA was 1.5 times higher as of a comparable lamp without mercury iodide.

What is claimed is

1. A low-pressure mercury vapor discharge lamp which comprises:

a discharge vessel;

at least two thermally emitting electrodes, mercury, at least one rare gas, and between 0.005 and 0.05 mg/cm$^3$ of mercury iodide being disposed in said discharge vessel; and said discharge vessel having a glass wall which is permeable to ultra-violet radiation generated in the mercury discharge.

* * * * *